US010280655B2

(12) United States Patent
Dragon et al.

(10) Patent No.: US 10,280,655 B2
(45) Date of Patent: May 7, 2019

(54) MOTOR VEHICLE DOOR LOCK

(71) Applicant: Kiekert AG, Heiligenhaus (DE)

(72) Inventors: Marek Dragon, Waldbröl (DE); Alexander Grossmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 4 days.

(21) Appl. No.: 15/516,200

(22) PCT Filed: Sep. 4, 2015

(86) PCT No.: PCT/DE2015/100377

§ 371 (c)(1),
(2) Date: Apr. 11, 2017

(87) PCT Pub. No.: WO2016/050236

PCT Pub. Date: Apr. 7, 2016

(65) Prior Publication Data

US 2017/0298658 A1 Oct. 19, 2017

(30) Foreign Application Priority Data

Oct. 2, 2014 (DE) ..... 10 2014 114 347

(51) Int. Cl.
*E05B 15/04* (2006.01)
*E05B 77/26* (2014.01)

(52) U.S. Cl.
CPC ..... *E05B 77/265* (2013.01); *E05B 15/04* (2013.01); *E05B 77/26* (2013.01); *E05B 2015/0468* (2013.01)

(58) Field of Classification Search
CPC . E05B 77/265; E05B 15/04; E05B 2015/0468
See application file for complete search history.

(56) References Cited

U.S. PATENT DOCUMENTS

| | | | | |
|---|---|---|---|---|
| 5,702,136 | A | 12/1997 | Funk et al. | |
| 9,200,478 | B2 * | 12/2015 | Connell | E05C 3/145 |
| 2008/0203737 | A1 * | 8/2008 | Tomaszewski | E05B 77/26 292/216 |

(Continued)

FOREIGN PATENT DOCUMENTS

| | | | |
|---|---|---|---|
| DE | 70 09 223 | U | 7/1970 |
| DE | 39 41 669 | A1 | 7/1990 |
| DE | 195 12 573 | A1 | 10/1996 |

(Continued)

OTHER PUBLICATIONS

International Search Report and Written Opinion for corresponding Patent Application No. PCT/DE2015/100377 dated Dec. 1, 2015.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The invention relates to a motor vehicle door lock comprising a locking mechanism consisting essentially of a rotary latch and a pawl, further comprising an actuation lever mechanism (2*a*, 2*b*) that acts on the pawl, and a child safety device (3) that includes a child safety lever (4) to which the force of a spring (5) is applied. According to the invention, the child safety lever (4) and the spring (5) are designed as a subassembly (4, 5).

14 Claims, 3 Drawing Sheets

(56) References Cited

U.S. PATENT DOCUMENTS

Figure 1:
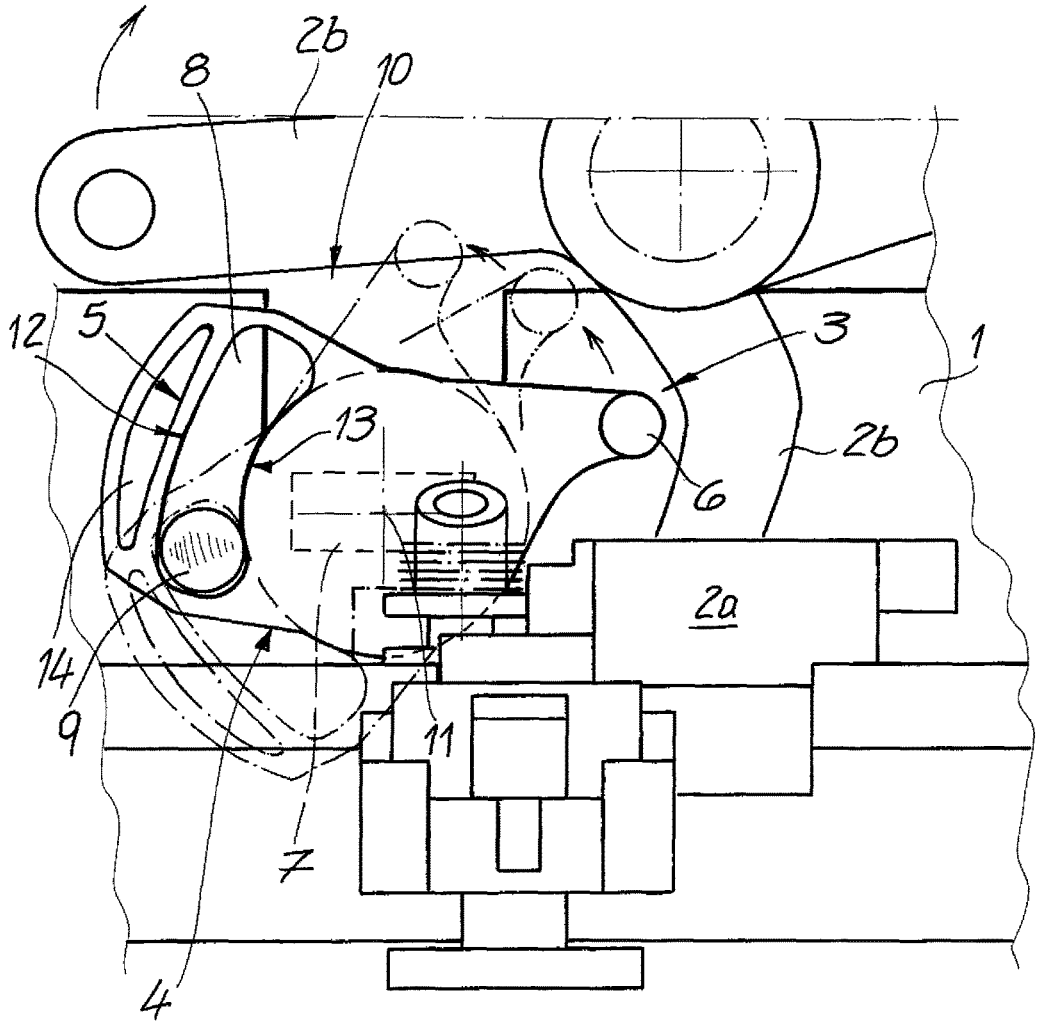

2011/0259061 A1 10/2011 Brose et al.

FOREIGN PATENT DOCUMENTS

| | | | |
|---|---|---|---|
| DE | 195 36 648 | A1 | 4/1997 |
| DE | 296 23 782 | U1 | 9/1999 |
| DE | 10 2007 05541 | | 5/2009 |
| DE | 20 2008 012484 | U1 | 2/2010 |
| EP | 1 387 028 | A2 | 2/2004 |

* cited by examiner

MOTOR VEHICLE DOOR LOCK

The invention relates to a motor vehicle door latch with a locking mechanism essentially comprising a catch and a pawl, furthermore with an activation lever mechanism working on the pawl and with a child lock device with a child lock lever impinged by a spring, whereby the child lock lever enables selective deactivation/activation of an internal door handle pertaining to the activation lever mechanism according to its position "child lock on" or "child lock off", while an external door handle remains activated in an unchanged manner.

With the aid of the child lock device a rear lateral door on a motor vehicle can typically be manipulated in such a way that in its "child lock on" position the internal door handle goes idle. In contrast, the pertaining lateral door can still be opened from the outside because the external door handle remains activated in an unchanged manner. The "child lock on" position of the child lock device or the child lock lever therefore corresponds to the aforementioned selective deactivation of the internal door handle, which consequently is set idle and not able to open the locking mechanism. In contrast, the "child lock off" position of the child lock device or the relevant child lock lever corresponds to the internal door handle being activated and consequently the pawl being able to be lifted from the catch by means of the activation lever mechanism. As a consequence hereof, the relevant motor vehicle lateral door can be easily opened, both internally and externally. This functionality has generally been proven and can naturally also be transferred and expanded to other motor vehicle doors.

Child lock devices have long been known, as made apparent, for example, by the utility model DE 70 09 223 of the applicant. The child lock is activated there using a child lock lever to be operated from the lock side of the door. The internal door activation consists of a remote activation lever and a coupling flap connected thereto. The coupling flap can be uncoupled from the remote activation lever with the aid of the child lock lever.

DE 195 36 648 A1 shows a motor vehicle door latch with a child lock element system and a child lock knob. The child lock knob is pivotably arranged in a bearing recess of the motor vehicle door latch. Furthermore, the child lock knob possesses a control cam working on a coupling element which circulates eccentrically in a circulatory plane. According to the position of the control cam, the pertaining activation lever mechanism for internal activation is disrupted or mechanically closed.

In the class-specific state of the art according to utility model DE 296 23 782 U1 a child lock system is executed with a child lock switching element. The child lock switching element is impinged by a rotary element accommodated in the housing of the motor vehicle door latch with an activation slot in the head, a so-called activation nut. For this purpose, a crank arm goes off the relevant rotary element to which the child lock switching element is connected. Furthermore, the crank arm works with a resetting spring.

A latching system, in particular for a door latch, is also further state of the art, as described within the scope of DE 10 2007 055 413 A1. This latching system demonstrates a rotating body which can be pivoted between a first stable position and a second stable position. A spring element is deflected along the pertaining movement track.

Although the previous designs of the child lock device are convincing in their function, they are designed with a great deal of constructional effort, because in addition to the child lock lever at least one additional spring is executed, with the aid of which the two end positions of the child lock lever or also only one end position is safely assumed. Furthermore, usually additional coupling levers, control cams and other elements are viewed as indispensable. This is where the invention is used.

The invention is based on the technical problem of further developing such a motor vehicle door latch in such a way that the structural effort in the execution of the child lock device is considerably reduced compared to previous execution forms.

In order to solve this technical problem, for a class-specific motor vehicle door latch the invention proposes that the child lock lever and the spring are formed as a constructional unit.

The child lock lever and the spring therefore form the relevant constructional unit within the scope of the invention. In this context, the spring ensures that, even with incomplete activation of the child lock lever, the desired end position is attained. i.e. the child lock lever can initially and fundamentally be transferred into its two end positions which correspond on the one hand to the "child lock on" position and on the other hand to the "child lock off" position. The "child lock on" functional position deactivates the internal door handle pertaining to the activation lever mechanism. In the "child lock off" position the pawl can be lifted from the catch in contrast and consequently the pertaining motor vehicle door latch can be opened by means of the activated internal door handle. In contrast, the external door handle is effective in both positions of the child lock device or the child lock lever.

In order that these two end positions are now safely assumed—even with incomplete activation—the spring ensures relevant force impingement. i.e. with its spring force, the spring transfers the child lock lever itself into one of its two end positions, even with incomplete activation.

Due to the fact that the child lock lever and the spring form a constructional unit, the technological and constructional effort is already significantly reduced. This because the manufacture and installation of the child lock lever including the spring take place together. The child lock lever and the spring do not necessarily need to be formed as a single component or a single part. Instead, it is sufficient if, for example, the child lock lever is equipped with the attached or suspended spring in order to execute the relevant constructional unit.

Further cost advantages are observed in this context, if furthermore according to an advantageous design the child lock lever and the spring are made of plastic, for example, in a materially uniform manner. In this case, the child lock lever and the spring are manufactured by a common plastic injection molding process in a common tool. This can be achieved especially simply and cost-effectively.

In detail, for this purpose the child lock lever is equipped with a guide nut for engaging of a pin. The interaction between the guide nut and the pin in conjunction with the spring ensures that the child lock lever safely reaches one of the two end positions, even when activation is incomplete.

The pertaining pin is typically a guide pin connected to a housing. A plastic lid for the motor vehicle door latch may regularly function as a housing. In fact, the motor vehicle door latch in essence comprises a motor vehicle door-side motor vehicle door latch and a chassis-side locking bolt. In principle, the procedure can also take place vice versa.

The motor vehicle door latch possesses a latch case and the aforementioned housing or a plastic lid sealing the latch case externally. In contrast, the latch case is made of metal. According to the invention, the plastic lid functions as a plastic housing. Consequently, the aforementioned pin can be easily formed on the relevant housing or plastic lid. To this end, the pin may also be made of plastic and formed from this in the manufacture of the housing or the plastic lid.

Thus, interaction takes place between the plastic pin and the guide nut which, due to the design of the child lock lever and the spring in a materially uniform manner, is also made of plastic or can be made of plastic via plastic walls. Favorable friction conditions between plastic and plastic are thus observed.

The pin is advantageously formed as a guide pin connected with the housing or the plastic lid. i.e. in conjunction with the guide nut, the pin ensures that the child lock lever is guided perfectly in the assumption of the two end positions "Child lock off" or "Child lock on". In order to pivot the child lock lever, for example, an activation nut is provided which can be accommodated in a corresponding aperture in the motor vehicle door latch or its housing. The activation nut possesses an activation slot in which, for example, a key, a screwdriver, a coin, etc. can engage for activation.

In this context, it has further been proven when the activation nut and the child lock lever are also formed from plastic in a materially uniform manner and consequently form a constructional unit. i.e. the child lock lever, the activation nut and the spring together constitute a single-component plastic injection-molded component which leads to low manufacturing costs overall. Furthermore, installation can be easily accomplished. With the aid of the activation nut the child lock lever is pivoted, typically into one of the end positions. The pivoting movement takes place taking into account a rotational axis which is defined by the activation nut engaging into the aperture of the housing, consequently, the aperture functions as a bearing or pivot bearing for the activation nut.

To enable the two end positions to be safely assumed and attained, the guide nut generally possesses a cross-sectional enlargement in the area of the respective end positions of the child lock lever; it is therefore formed in a cross-sectionally enlarged manner. Furthermore, the guide nut is limited in its lengthwise extension by both a radially internal stop wall and a radially external spring wall as a spring in relation to the rotational axis of the child lock lever. i.e. the guide nut possesses the stop wall and the spring wall as lengthwise walls between the two cross-sectionally enlarged end positions. The spring wall assumes the function of the spring as a component of the child lock lever.

In this context, the stop wall is usually arc-shaped compared to the relevant rotational axis which acts as a circle center in this context. Compared to the arc-shaped stop wall, the spring wall demonstrates a predominantly straight extension in contrast. In fact, the spring wall is generally designed as an elastic bridge between the radially internal guide nut in contrast and a radially external recess.

The recess ensures that the spring wall is elastically deflected as a spring and can escape into this recess. As a consequence of the predominantly straight design of the spring wall or the elastic bridge compared to the arc-shaped design of the stop wall, the guide nut generally demonstrates a lesser cross-section than the pin guided therein in the transition area between the two end positions of the child lock lever. Only in the two end positions does the cross-section of the guide nut largely correspond to that of the pin guided in the guide nut. Thus, the pin guided in the guide nut finally ensures that the spring wall is elastically deformed in the transition area between the two end positions.

As a consequence of this elastic deformation of the spring wall in the transition area, a resetting force is generated on the child lock lever. The resetting force ensures that the child lock lever is transferred into one of the end positions according to its angular position. The angular position of the child lock lever corresponds to a pivoting position compared to its rotational axis. The design is usually such that the resetting force thus works on the child lock lever in such a way that it is transferred into the end position which corresponds to a lesser pivot angle compared to the transfer into the other end position.

The invention achieves perfect positioning of the child safety lever and ensures that it is fixed in one of the two end positions. This applies even if the child lock lever is activated with the aid of the activation nut or alternatively only incompletely. In any case, the invention ensures that in both complete and incomplete activation of the child lock lever this safely assumes either the "child lock on" or the "child lock off" position due to the resetting forces generated with the aid of the spring wall. This is all attained with a strikingly simple construction which is also distinguished by especially low costs. These are the essential advantages.

Figure 2:
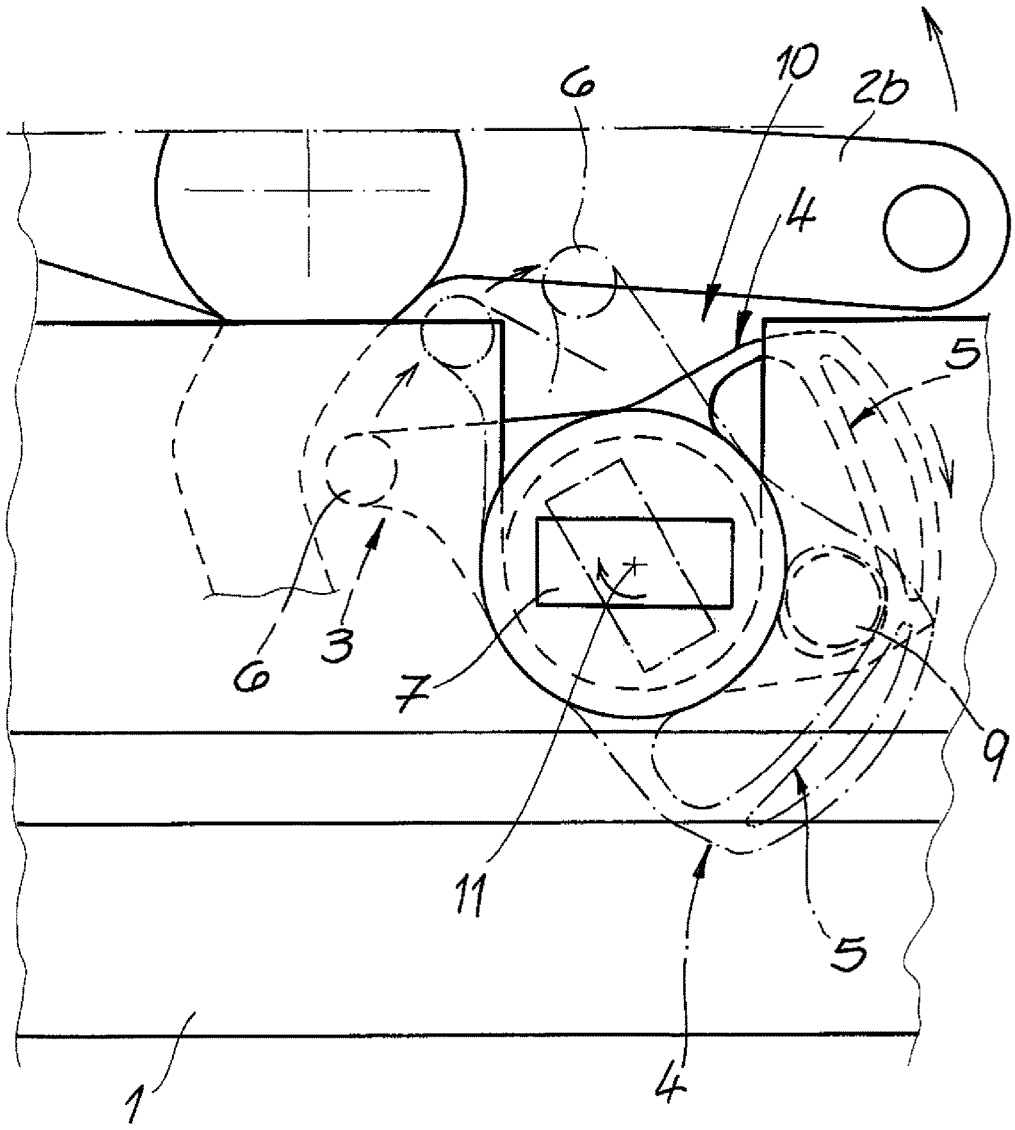
Figure 3:
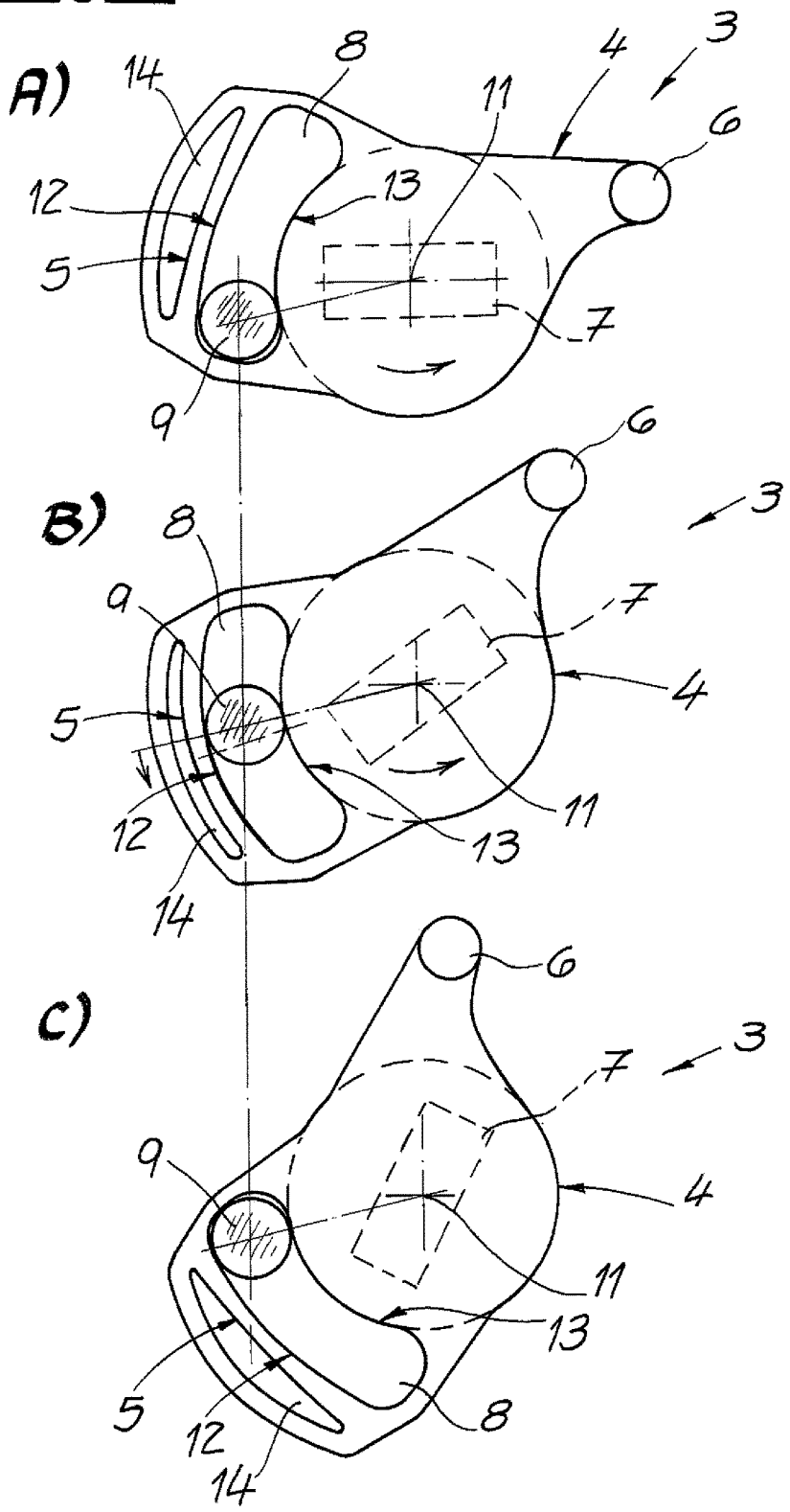

Hereinafter, the invention is explained in further detail on the basis of a drawing which only depicts an execution example. It shows:

FIG. 1 the motor vehicle door latch according to the invention in a rear view seen from the inside of the motor vehicle door latch, FIG. 2 the object according to FIG. 1 in a front view with the activation nut and FIG. 3A to 3C the child lock device separately in different functional positions.

In the figures a motor vehicle door latch is depicted which is reduced to the components and elements crucial for the invention. A housing 1 is initially apparent which, in the present case, is formed as a plastic lid and latches a non-illustrated latch case. The latch case is typically arranged in a drawing plane above the drawing plane illustrated in FIG. 1 and is not illustrated for reasons of clarity. As usual, the purpose of the latch case is to accommodate a locking mechanism which is also not illustrated, consisting of a catch and a pawl. A partially apparent activation lever mechanism 2*a*, 2*b* which is only illustrated in extracts in the internal view according to FIG. 1 and depicts an internal activation component works on the pawl. Furthermore, a child lock device 3 is apparent which is equipped with a child lock lever 4. The child lock lever 4 is impinged by a spring 5. According to the invention, the child lock lever 4 and the spring 5 are formed as a constructional unit 4, 5.

In the illustration according to FIG. 1 or 3A the child lock lever 4 is located in its "child lock on" position in which the child lock lever 4 interrupts an internal activation lever chain or an internal activation via the activation lever mechanism 2*a*, 2*b* pertains to an idle stroke on a non-illustrated internal door handle. In contrast, the position depicted in dot dashes in FIG. 1 or the "child lock off" position shown in FIG. 3C corresponds to an internal activation being possible via the activation lever mechanism 2*a*, 2*b* and consequently the pawl can be lifted from the catch. In both "child lock on" and "child lock off" functional positions the illustrated motor vehicle door latch can still be activated externally.

Specifically, the design may be such that the child lock lever 4 apparent in FIG. 1 or 3A in the "child lock on" position illustrated blocks an internal activation lever 2*b* as a component of the activation lever mechanism 2*a*, 2*b* in this position with a pin 6 located on the end or causes an idle stroke if the internal activation lever is pivoted around its axis in the arrow direction illustrated in FIG. 1. Because hereby the two lever arms connected by a spring are uncoupled from one another or the lever arm running against the stop 6 is blocked. Consequently, this cannot lift the pawl from the catch either directly or indirectly.

The two functional positions illustrated in FIG. 1 or FIG. 3A and 3C "child lock on" and "child lock off" of the child lock lever 4 can be specified with the aid of an activation nut 7 in the example case apparent in the front view according to FIG. 2. Instead of the activation nut 7 the child lock lever 4 can naturally also be manually (or even automatically) pivoted to any other type. In the execution example, the activation nut 7 connected integrally with the child lock lever 4 ensures that the child lock lever 4 assumes either its "child lock on" end position or the "child lock off" end position with the previously described consequences.

According to the invention, it now not only depends on the child lock lever 4 being able to be transferred into the two end positions illustrated, but these end positions also need to be maintained with positional accuracy. Only thus can unintentional engagement or disengagement of the child lock device 3 or the child lock lever 4 be prevented. For this purpose, the child lock lever 4 possesses the aforementioned spring 5. In fact, the child lock lever 4, 5 and the spring 5 are formed as a constructional unit 4, 5 according to the invention. In the design example, the child lock lever 4 and the spring 5 are designed in a materially uniform manner from plastic, for example. In the design example, the activation nut 7 is added to the constructional unit 4,5. Consequently, a constructional unit 4, 5, 7 comprising the child lock lever 4, the spring 5 and finally the activation nut 7 is present which is designed as a single-component plastic injection molded component 4, 5, 7. Naturally, this only constitutes an example and is not compulsory.

On the basis of the illustration in FIG. 1, it is apparent that the child lock lever 4 is equipped with a guide nut 8 to engage a pin 9. The pin 9 is connected to the housing 1 and in the present case is designed as a guide pin 9 for the child lock lever 4. In fact, the guide pin 9 in conjunction with the activation nut 7 which engages into a pertaining aperture 10 of the housing 1 apparent in FIG. 2 ensures both that a rotational axis 11 of the child lock lever 4 is defined and that the child lock lever 4 is perfectly guided around the rotational axis 11 in this pivoting movement with the aid of the pin 9 engaging into the guide nut 8.

On the basis of FIG. 1 and FIG. 3A to 3C it is apparent that the guide nut 8 is designed in a cross-sectionally enlarged manner in the area of the respective end positions of the child lock lever 4. In fact, the guide nut 8 in the region of the two end positions demonstrates a cross-section which corresponds to the cross-section of the pin or the guide pin 9 engaging into the guide nut 8. In contrast, for a transitional area 12, 13 between the two end positions a cross-section of the guide nut 8 is observed which is less than the cross-section of the guide pin 9. As a consequence hereof, the spring 5 is deformed as illustrated in FIG. 3B.

In fact, in its lengthwise extension the guide nut 8 is limited both by a stop wall 13 and a spring wall 12 as a spring 5. Compared to the rotational axis 11, the stop wall 13 is radially internally arranged compared to the guide nut 8, whereas the spring wall 12 is arranged and corresponds radially externally compared to the rotational axis 11.

It is apparent that the stop wall 13 is arc-shaped compared to the rotational axis 11 which functions as the circle center in this regard. In contrast, the spring wall 12 predominantly has a straight extension. In fact, the spring wall 12 is designed as an elastic bridge 12 between the aforementioned guide nut 8 and a recess 14. The recess 14 ensures that the spring wall 12 acting and functioning as a spring 5 can escape into this recess 14 with any deformation by the guide pin 9 (cf. FIG. 3B). It is apparent that the recess 14 is arranged radially externally compared to the rotational axis 11 of the child lock lever 4, while the guide nut 8 possesses a radially internal arrangement in contrast.

As already explained, the predominantly straight design of the spring wall 12 in conjunction with the arc shape of the stop wall 13 overall leads to the guide nut 8 in the transition area 12, 13 demonstrating a lower cross-section than the guided pin 9 between the two end positions of the child lock lever 4. As a consequence hereof, the pin 9 ensures that the spring wall 12 is elastically deformed in the transition area 12, 13. Due to the elastic deformation, the spring wall 12 generates a resetting force on the child lock lever 4. This is shown in FIG. 3B. It is apparent there that the child lock lever 4 was activated incompletely. Thus, the pin 9 is located in the transition area 12, 13. The spring wall 12 is elastically deformed and generates a resetting force in a counterclockwise direction in relation to the rotational axis 11. Thus, the incompletely activated child lock lever 4 is impinged in the direction of the "child lock off" position according to FIG. 3C.

The resetting force of the spring wall 12 is calculated in such a way that the child lock lever 4 is transferred into one of the end positions according to its angular position compared to the rotational axis 11. However, overall this ensures that the child lock lever 4 is perfectly positioned even if the child lock lever 4 has been incompletely impinged with the aid of the activation nut 7. In this case, the spring wall 12 is deformed in the transition area 12, 13, which functions as a spring 5 ensures that the resetting force generated by the deformation transfers the child lock lever 4 into the next angular end position. The next angular end position corresponds to a smallest pivot angle in relation to the two fundamentally attainable end positions.

Consequently, if the guide pin 9 plunged into the guide nut 8 is located in closer angular proximity to the "child lock on" end position than to the "child lock off" end position, the resetting force generated by the deformation of the spring wall 12 ensures that the child lock lever 4 is automatically pivoted into the closer angular proximity "child lock on" end position.

The invention claimed is:

1. A motor vehicle door latch with a locking mechanism comprising:

an activation lever mechanism that opens the locking mechanism from inside the motor vehicle; and a child lock device moveable between an activated position in which the activation lever mechanism is disconnected from the locking mechanism and a deactivated position in which the activation lever mechanism is connected to the locking mechanism, the child lock device including:

a child lock lever that is rotatable and engageable with the activation lever mechanism to block the activation lever mechanism from being connected with the locking mechanism when the child lock device is in the activated position; and a spring connected to the child lock lever, wherein the child lock lever and the spring are integrally formed as a single element, and the spring is deformable to force the child lock device toward the activated position when the child lock lever is in a first intermediate position in which a first pivot angle between the child lock lever and the activated position is less than a second pivot angle between the child lock lever and the deactivated position, and toward the deactivated position when the child lock lever is in a second intermediate position in which the second pivot angle is less than the first pivot angle.

2. The motor vehicle door latch according to claim 1, wherein the child lock lever and the spring are formed from a uniform material.

3. The motor vehicle door latch according to claim 2, wherein the uniform material is plastic.

4. The motor vehicle door latch according to claim 1, wherein the child lock lever includes a guide nut that is arranged between the child lock lever and the spring, and receives a pin.

5. The motor vehicle door latch according to claim 4, wherein the pin is formed as a guiding pin connected to a housing.

6. The motor vehicle door latch according to claim 4, wherein the guide nut has a first end and a second end and the guiding pin is moveable between the first end and the second end, and wherein the child lock device is in the activated position when the guiding pin is at the first end and in the deactivated position when the guiding pin is at the second end.

7. The motor vehicle door latch according to claim 6, wherein the guide nut includes a transition area between the first end and the second end, the transition area having a smaller cross-section than the guiding pin guided therein, the spring being deformable in the transition area when the child lock device is in the intermediate position.

8. The motor vehicle door latch according to claim 7, wherein the spring generates a resetting force on the child lock lever in the transition area, whereby the guiding pin is moved into a closer end of the first end or the second end according to an angular position of the guiding pin.

9. The motor vehicle door latch according to claim 6, wherein the first end and the second end are cross-sectionally enlarged relative to an area of the guide nut between the first end and the second end.

10. The motor vehicle door latch according to claim 4, wherein the guide nut is limited in a lengthwise extension both by a radially internal stop wall in relation to a rotational axis of the child lock lever and a radially external spring wall of the spring.

11. The motor vehicle door latch according to claim 10, wherein the stop wall is formed as a circle center in an arc shape compared to the rotational axis.

12. The motor vehicle door latch according to claim 10, wherein the spring wall is formed as an elastic bridge between the guide nut and a radially external recess.

13. The motor vehicle door latch according to claim 1, wherein the activation lever mechanism includes an internal activation lever that opens the locking mechanism from inside the motor vehicle, and an external activation lever that opens the locking mechanism from outside the motor vehicle, wherein the child lock is engageable with the internal activation lever.

14. The motor vehicle door latch according to claim 1, wherein the child lock device includes an activation nut that is formed integrally with the child lock lever.

* * * * *